US011401108B2

(12) United States Patent
Reeb et al.

(10) Patent No.: US 11,401,108 B2
(45) Date of Patent: Aug. 2, 2022

(54) LOCKING DEVICE

(71) Applicant: Serio-Us Industries, Inc., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 157 days.

(21) Appl. No.: 17/028,597

(22) Filed: Sep. 22, 2020

(65) Prior Publication Data

US 2021/0061557 A1 Mar. 4, 2021

Related U.S. Application Data

(63) Continuation of application No. 15/589,206, filed on May 8, 2017, now Pat. No. 10,781,041.

(60) Provisional application No. 62/332,756, filed on May 6, 2016.

(51) Int. Cl.
*B65F 1/16* (2006.01)

(52) U.S. Cl.
CPC ..... *B65F 1/1615* (2013.01); *B65F 1/1646* (2013.01); *B65F 2001/1669* (2013.01)

(58) Field of Classification Search
CPC ..... B65F 1/1615; B65F 1/1646; B65F 2001/1669; B65F 1/122; B65F 1/1623; B65F 1/16; B65F 1/1426; B65F 1/1638; Y10S 220/908; Y10S 209/93; Y10S 292/04; E05B 15/0093; E05B 65/006; E05B 65/5292; Y10T 292/1063; Y10T 292/0937; B65D 2251/1058
See application file for complete search history.

(56) References Cited

U.S. PATENT DOCUMENTS 3,032,216 A 5/1962 McCarthy
5,094,358 A * 3/1992 Serio, Sr. ..... E05B 15/0093 292/205
5,201,434 A 4/1993 Devivo et al.
5,224,744 A * 7/1993 Michelutti ..... B65F 1/1615 292/234
5,415,314 A * 5/1995 McCollum ..... E05B 15/0093 220/264
5,419,598 A * 5/1995 Kreitzer ..... E05C 3/048 292/205
5,474,341 A * 12/1995 Putman ..... B65F 1/1615 414/407

(Continued)

*Primary Examiner* — Mark A Williams
(74) *Attorney, Agent, or Firm* — Berenato & White, LLC

(57) ABSTRACT

The present invention generally relates to waste containers and, more particularly, relates to a safety locking device for waste containers. The locking device contains a base unit and a pivoting unit pivotally mounted to the base unit. The base unit contains a pinion member, having a cam thereon, non-movably attached to the base member. The pivoting unit includes a lock casing defining a cavity which houses a locking mechanism. The locking mechanism contains a locking member which is pivotally movable between a blocking position to prevent relative movement between the pivoting unit and the base unit, and a release position to permit the relative movement between the pivoting unit and the base unit.

20 Claims, 11 Drawing Sheets

(56) References Cited

U.S. PATENT DOCUMENTS 5,599,050 A * 2/1997 Tinsley ..... B65F 1/1615 292/210
5,683,126 A * 11/1997 De Vivo ..... B65F 1/1615 292/210
5,997,052 A * 12/1999 Reeb ..... E05B 15/0093 292/148
6,666,485 B1 * 12/2003 Moret ..... B65F 1/1615 292/130
6,851,288 B2 * 2/2005 Howes ..... B65F 1/1615 70/164
7,234,327 B2 6/2007 Howes
7,806,447 B2 10/2010 Reeb
9,580,243 B2 * 2/2017 Reeb ..... E05B 67/38
9,828,177 B2 * 11/2017 Nussbaum ..... E05B 15/0093
9,856,058 B1 * 1/2018 Arthurs ..... E05B 15/0093
9,975,695 B2 5/2018 Reeb et al.
10,221,010 B2 * 3/2019 Reeb ..... B65F 1/1615
10,287,095 B2 * 5/2019 Reeb ..... E05B 15/0093
10,781,041 B2 * 9/2020 Reeb ..... B65F 1/1646
2007/0090114 A1 * 4/2007 Rouns ..... B65F 1/1615 220/908
2009/0066092 A1 * 3/2009 Reeb ..... B65F 1/1615 292/184
2009/0091141 A1 * 4/2009 Kreitzer ..... B65F 1/1615 292/130
2010/0102575 A1 * 4/2010 Ferkovich ..... B65F 1/1615 292/259 R
2014/0208813 A1 * 7/2014 Reeb ..... B65F 1/1646 70/277
2014/0314530 A1 10/2014 Strom
2016/0159570 A1 * 6/2016 Reeb ..... E05B 65/006 292/197
2016/0355334 A1 * 12/2016 Reeb ..... E05B 65/52
2017/0043950 A1 * 2/2017 Reeb ..... B65F 1/1646

* cited by examiner

LOCKING DEVICE

CROSS-REFERENCE TO RELATED APPLICATIONS AND CLAIM TO PRIORITY

This is a continuation application of U.S. application Ser. No. 15/589,206, filed May 8, 2017, now U.S. Pat. No. 10,781,041, which claims the priority of U.S. Provisional Patent Application No. 62/332,756, filed May 6, 2016, the disclosures of which are incorporated herein by reference.

FIELD OF THE INVENTION

The present invention generally relates to waste containers and, more particularly, relates to a safety locking device for waste containers.

BACKGROUND OF THE INVENTION

As is well known, waste containers, such as refuse containers for use in residential and industrial applications, typically include a container supported on a base structure. With the advent of mechanized trash removal, there have been created a number of large sized trash bins or dumpster containers. These containers usually comprise a block-shaped or pyramid-shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container. Many of these large trash receptacles are rented from a trash removal service. These receptacles are not provided free of charge, and consequently their frequent emptying and service can become a considerable expense. This expense is increased when unauthorized users freely deposit trash therein. This unauthorized use necessitates a more frequent emptying of the container, and of course the unauthorized user does not contribute to the increased expense.

In order to reduce the added expense that comes from unauthorized use, the dumpsters may be locked. While conventional chains and padlocks reduce unauthorized dumpster use, they also add to operating expenses because the driver of the truck emptying the dumpster must get out of the truck to unlock the padlock on the dumpster and then reverse the process after emptying. In the early 1990's, companies began the development and marketing of dumpster locking mechanisms that open automatically when the dumpster is lifted and inverted to dump the trash into the truck. With such as automatic lock, the driver is not required to leave the truck, which saves the trash company hundreds of dollars each year.

Conventional automatic locks are typically bulky, expensive and difficult to mount to multiple containers. Since containers come in a variety of shapes and sizes, it is important that the locking device be sized and shaped to be retro fit onto a variety of existing containers. Moreover, the locking device must be able to withstand the rigors of everyday, outdoor use in the waste environment.

Therefore, there exists a need for an automatic locking device that improves upon prior automatic locking devices and solves the problems inherent in known automatic locking devices.

SUMMARY OF THE INVENTION

A first aspect of the invention provides a locking device for a container having a hinged lid. The locking device contains a base unit and a pivoting unit pivotally mounted to the base unit. The base unit is adapted to be fixed to the container and contains a pinion member, having a cam thereon, non-movably attached to the base member. The pivoting unit includes a lock casing defining a cavity which houses a locking mechanism. The locking mechanism contains a locking member pivotally mounted to the lock casing, and a sliding member reciprocatingly and slidingly movable between the locking member and the pinion member within the cavity. The sliding member drivingly engages the pinion member via the cam on the pinion member, so that rotational movement of the pivoting unit relative to the base unit causes linear displacement of the sliding member toward the locking member (and thus away from the pinion member). The locking member is pivotally movable between a blocking position preventing the movement of the sliding member relative the pinion member so as to prevent relative movement between the pivoting unit and the base unit, and a release position permitting the movement of the sliding member relative the pinion member so as to permit relative movement between the pivoting unit and the base unit.

A second aspect of the invention provides a container having a hinged lid over an opening thereof and a locking device mounted to a first side wall of the container. A support member is mounted to a second side wall, opposing the first side wall. The support member has a pivoting arm pivotally mounted thereto. A locking bar connects the pivoting unit and the pivoting arm. In the closed position, the locking bar is positioned over the hinged lid to prevent it from opening. In the open position, the locking arm is spaced away from the hinged lid to allow the lid to be lifted away from container, thereby opening the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION OF THE PREFERRED EMBODIMENT(S)

Figure 1:
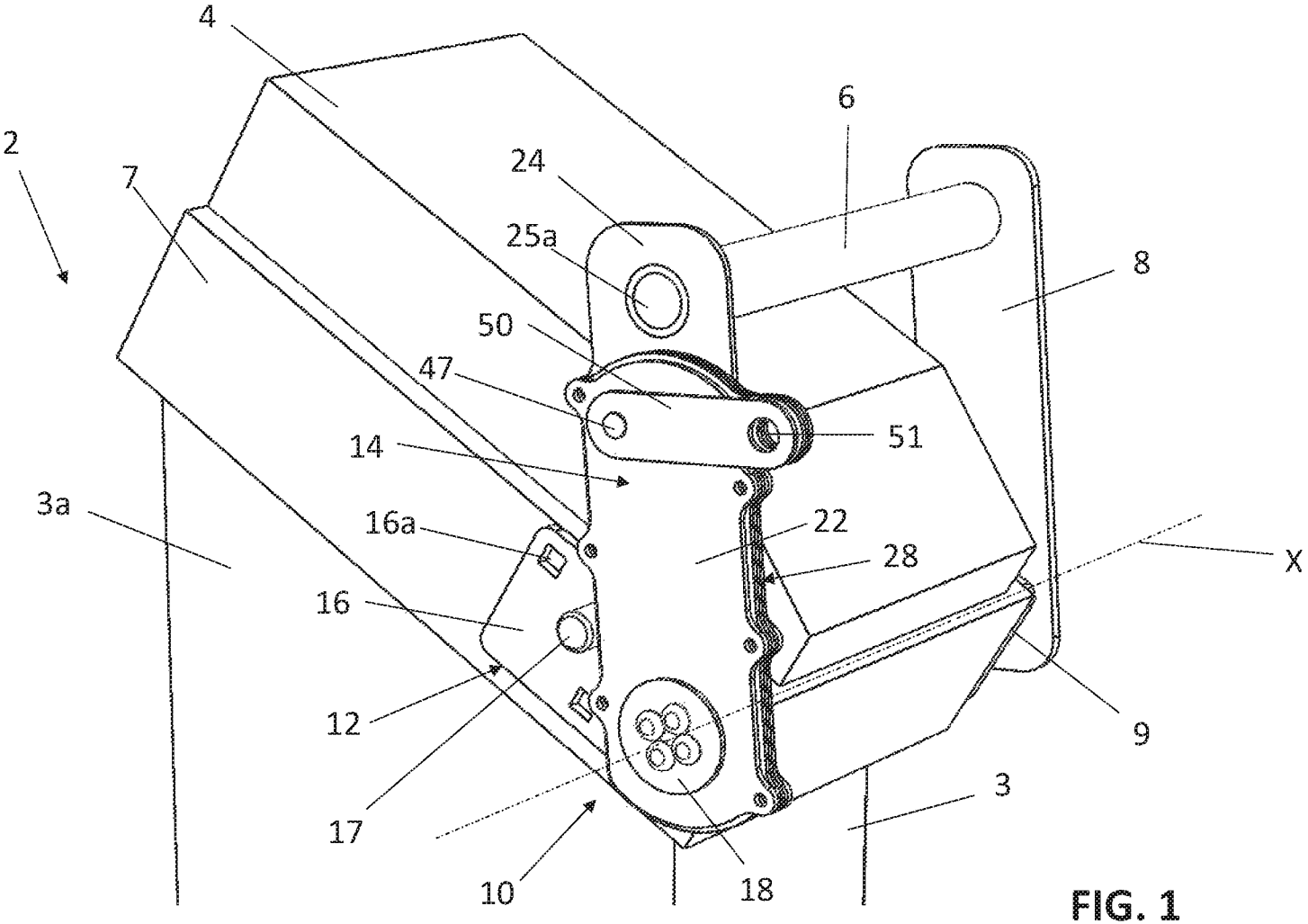
FIG. 1 is a perspective view from a right side of a waste container in an upright position with a locking device in a close position.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top", "bottom", "forward", and "backward" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. Additionally, the word "a" and "an" as used in the claims means "at least one" and the word "two" as used in the claims means "at least two".

Figure 2:
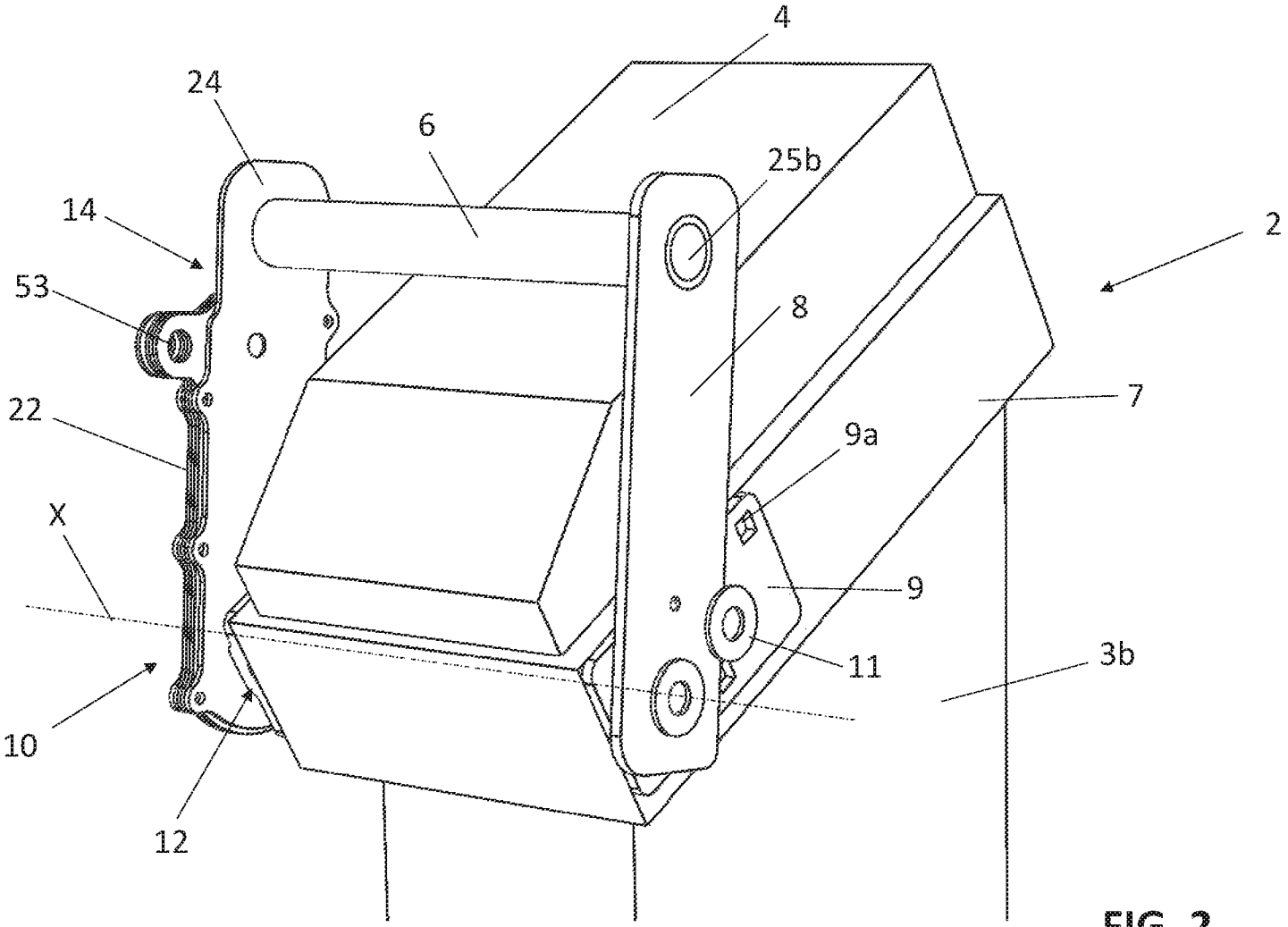
FIG. 2 is a perspective view of the waste container in FIG. 1 from the left side.
Figure 3:
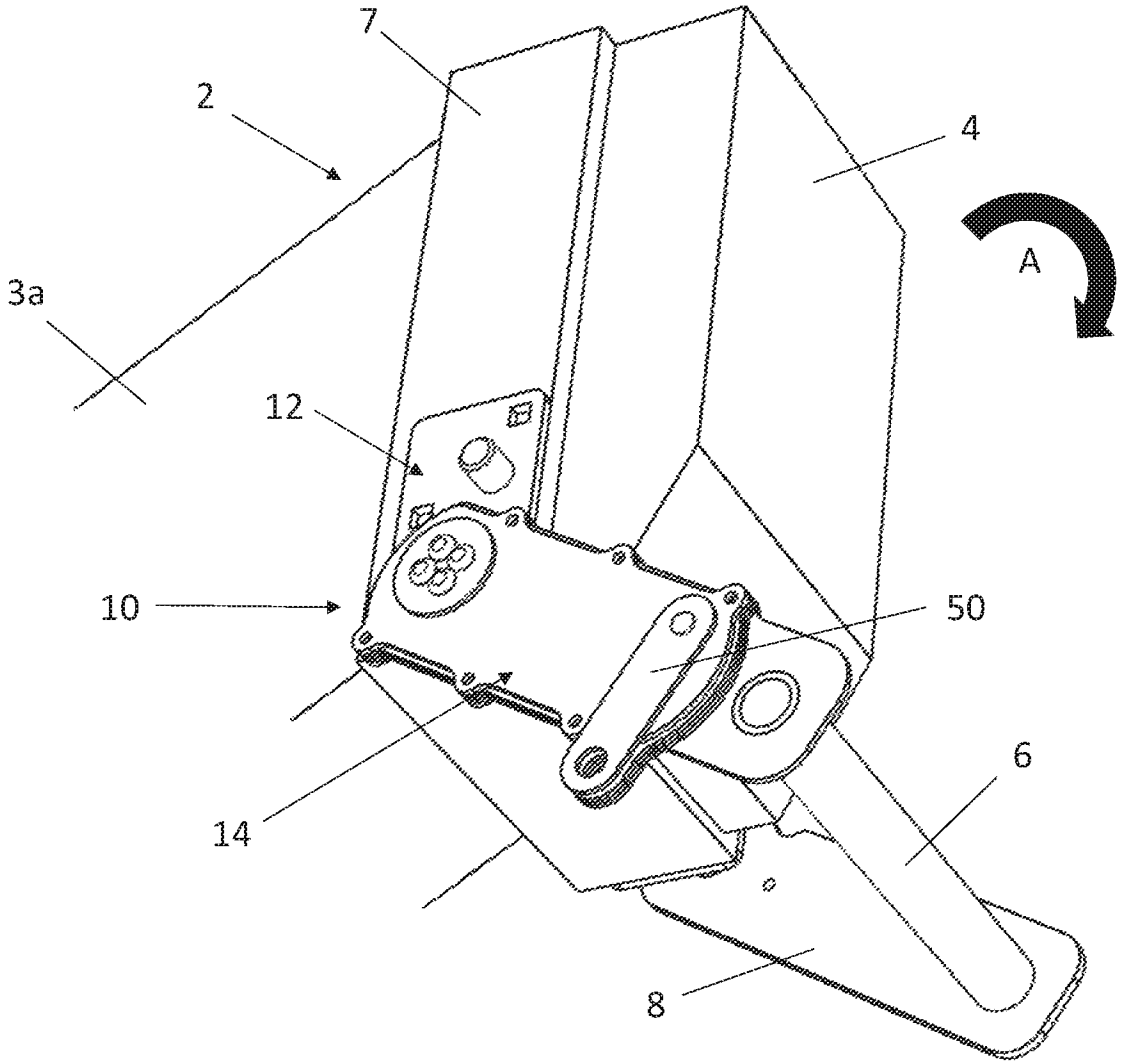
FIG. 3 is a fragmentary perspective view of the waste container of FIG. 1 in a tilted position with the locking device in the open position.

FIGS. 1-3 illustrates a waste or storage container 2, such as a trash collector or dumpster, including a container body 3, at least one hinged lid 4 pivotally mounted thereto, a safety locking device 10 and a locking bar 6 extending across the length of and above the waste container 2. The locking device 10 is provided for locking and unlocking the hinged lid 4 of the waste container 2 to prevent unauthorized access of it. The locking bar 6 extends between the locking device 10 at one end and a pivoting arm 8 at the other end thereof. The locking device 10 is preferably mounted to a side wall 3*a* of the container body 3 (herein defined as a lock side of the container body 3), while the pivoting arm 8 is preferably pivotally mounted to the opposite side wall 3*b* thereof (herein defined as a dummy side of the container body 3). Although the drawings show the lock side as the right side of the container body 3 and the dummy side as the left side of the container body 3, the reverse is also within the scope of the present invention, where the lock side is the left side of the container body 3 and the dummy side is the right side of the container body 3. The lock side and the dummy side may be located anywhere on the container as long as the locking bar 6 may be positioned over the lid 4 to block the opening of the container 2, and moved to be spaced from the lid 4 to allow opening of the container 2. The locking device 10 may be mounted to a flanged lip 7 of the container body 3 or directly to a side of the container body 3.

The waste container 2, as illustrated in FIGS. 1-3, is generally an industrial-type dumpster used for retaining, storing, and eventually disposing of refuse (waste). The container 2 may be tilted or otherwise pivoted from an upright (or on-the-ground) position (wherein the waste container 2 is sitting generally horizontally on the ground) (shown in FIG. 1) to a tilted or dumping position (shown in FIG. 3).

The locking device 10 includes a base unit 12 fixed to the right side wall 3*a* of the waste container 2, and an elongated pivoting unit 14 pivotally mounted to the base unit 12 for pivotable movement relative to the base unit 12 about a pivot axis X, as best shown in FIG. 2. Herein, the axial and radial orientations are considered with respect to the pivot axis X of the locking device 10. The relative terms such as "axially," "radially," and "circumferentially" are with respect to orientations parallel to, perpendicular to, and around the pivot axis X, respectively. The relative terms such as "inwardly" and "outwardly" and derivatives thereof are with respect to orientations toward or away from the pivot axis X, respectively.

The locking bar 6 is secured to the pivoting unit 14 at a distal end thereof so as to extend across the length of the waste container 2, as illustrated in FIGS. 1-3. The pivoting unit 14, the pivoting arm 8 and the locking bar 6 movable therewith are provided to translate from a closed position (shown in FIGS. 1-2) wherein the locking bar 6 extends over the hinged lids 4 of the waste container 2 so as to prevent opening of the waste container 2 (prevent lifting of the lid 4 away from the container body 3), as illustrated in FIGS. 1-2, to an open position (shown in FIG. 3) wherein the locking bar 6 is spaced away from the hinged lid 4 of the waste container 2 so as to allow the opening of the hinged lid 4 of the waste container 2 (allow the lid to be lifted away from the container body 3), as illustrated in FIG. 3.

Figure 4:
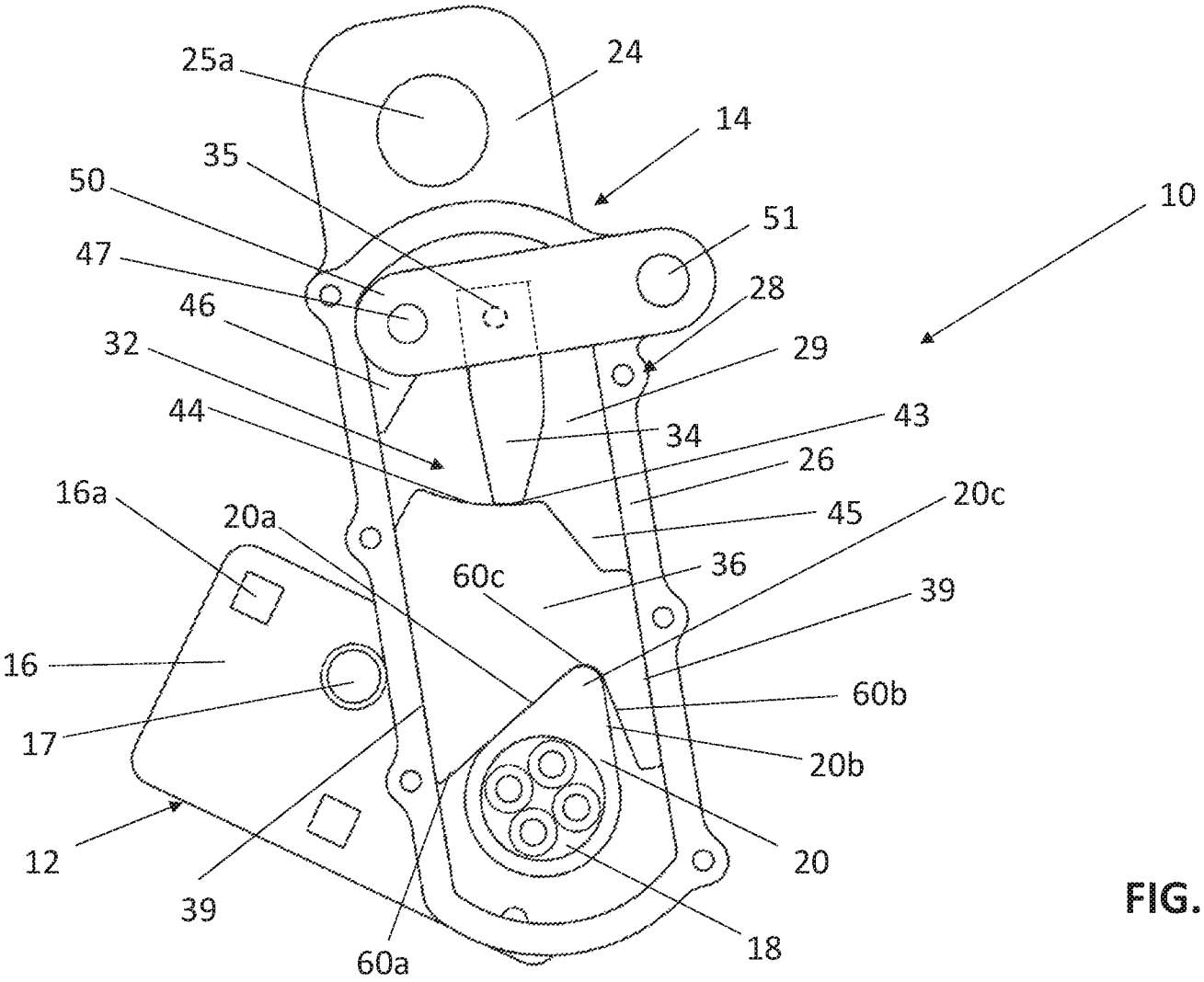
FIG. 4 is a side view of the locking device in a close position without an outer plate.
Figure 5:
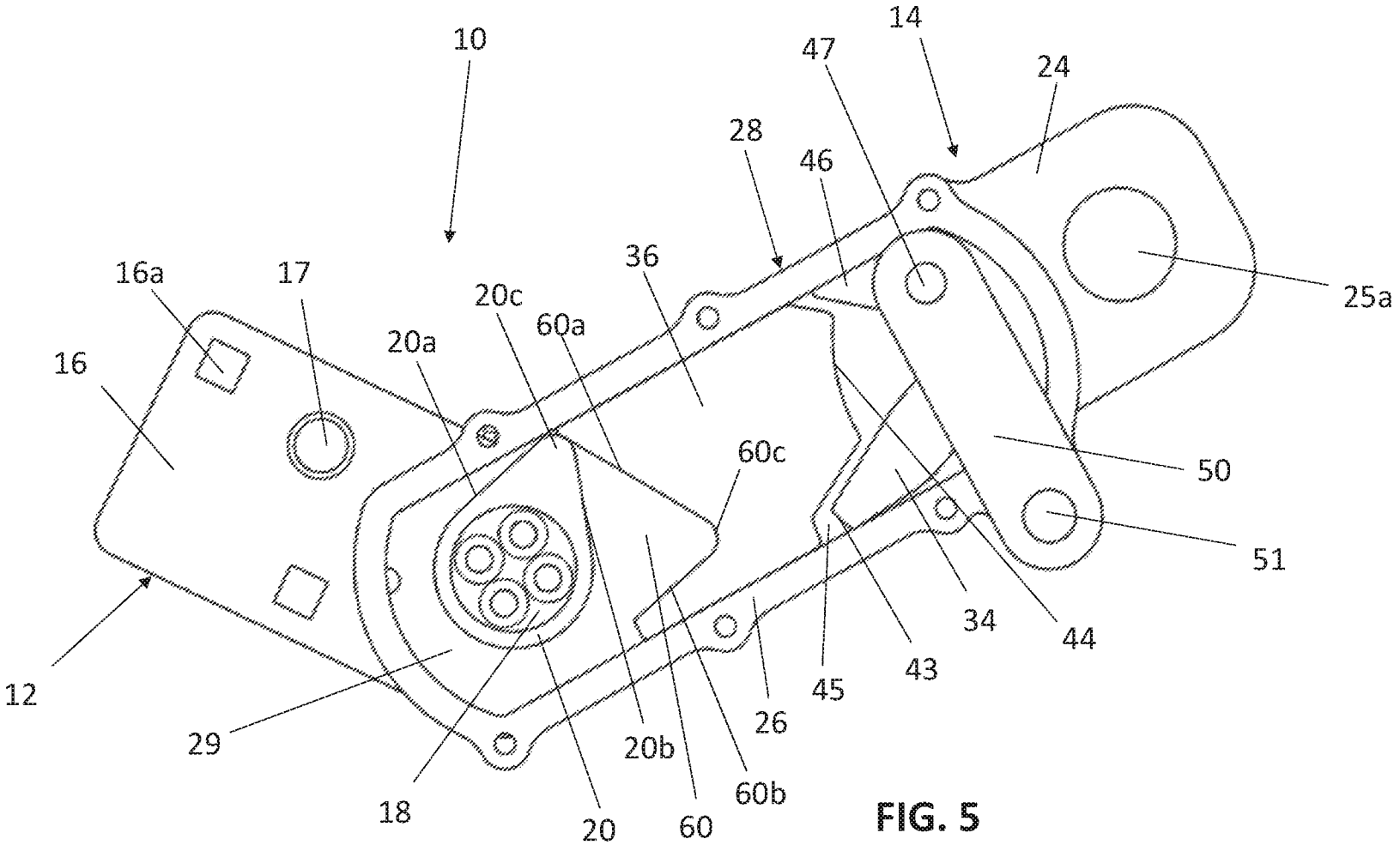
FIG. 5 is a side view of the locking device in an open position without an outer plate.

The base unit 12, as illustrated in detail in FIGS. 1, 3, 4, and 5, includes a base member (or base plate) 16 non-movably fastened to the right side wall 3*a* of the waste container 2 by appropriate means known in the art, such as adhesive, screws, nut/bolt, etc., and a pinion member 18 non-movably attached (i.e., fixed relative to the base unit 12) to the base member 16. As illustrated in FIGS. 4-5, the pinion member 18 includes a cam 20 along at least a portion of a perimeter thereof. According to an exemplary embodiment of the present invention, the cam 20 is formed on the perimeter of the pinion member 18. The cam 20 may, partially or entirely, encircle the pinion member 18.

According to an exemplary embodiment of the present invention, as illustrated in FIGS. 1, 3, and 4-6, the base member 16 is in the form of a substantially flat metal plate having at least two holes 16*a* therethrough and fastened to the right side wall 3*a* of the waste container 2 by mechanical fasteners (not shown in detail) extending through the holes 16*a*. As further illustrated in FIGS. 4-5, the base unit 12 further includes a stop member 17, which is fixed (i.e., non-moveably secured) to the base member 16 and extends approximately perpendicularly from the plane of the base member 16, for limiting counterclockwise and clockwise rotation of the pivoting unit 14 about the pivot axis X.

Similarly, as best shown in FIG. 2, the support member 9 includes a stop member 11, which is fixed (i.e., non-moveably secured) to the support member 9 and extends approximately perpendicularly therefrom, for limiting counterclockwise and clockwise rotation of the pivoting arm 8 about the pivot axis X by engaging a lower (or proximal) end of the pivoting arm 8 as shown in FIG. 2. As further illustrated in FIG. 7, the pivoting arm 8 preferably has a concave support recess 8*a* complementary to a cylindrical outer surface of the stop member 11. The support recess 8*a* provides improved seating of the pivoting arm 8 on the stop member 11.

In the exemplary embodiment of the present invention, the pinion member 18 is non-movably attached (i.e., fixed) to the base member 16 of the base unit 12. Moreover, the pinion member 18 is substantially coaxial with the pivot axis X. In the exemplary embodiment of the present invention best shown in FIGS. 4-5, the pinion member 18 may be in the form of a flat metal plate fixed to the base member 16 of the base unit 12 and having the cam 20 along a portion of a perimeter thereof. The pinion member 18 may be made of metal or any other appropriate material.

The pivoting unit 14 contains an outer (or cover) plate 22 (shown in FIGS. 6 and 10), an inner (extended) plate 24, and one or more hollow plate-shaped intermediate member(s) 26 (shown in FIGS. 1-6). The inner plate 24 is pivotally mounted to the base member 16 and is non-movably attached (i.e., fixed) to the outer plate 22 through the intermediate member 26. In other words, the intermediate member 26 is sandwiched between the inner plate 24 and the outer plate 22 so as to form an integral lock casing 28 defining a cavity 29 therein (as best shown in FIGS. 4-5).

The locking bar 6 may be mounted, on one end, to the inner plate 24 by appropriate means known in the art, such as adhesive, welding, etc., to extend over the hinged lid 4 of the waste container 2 in the closed position, as shown in FIGS. 1-2. The inner plate 24 may include a circular opening 25*a* (as best shown in FIGS. 1 and 4-6) provided for mounting the locking bar 6 to the inner plate 24 of the locking device 10. Likewise, the locking bar 6 may be mounted, on its other end, to the pivoting arm 8. The pivoting arm may include a circular opening 25*b* (as best shown in FIG. 2) for mounting the locking bar 6.

The inner plate 24 is pivotally mounted to the base member 16 for rotation about the pinion member 18. Thus, the pivoting unit 14 is mounted to the base unit 12 for pivoting movement between a closed position (shown in FIGS. 1-2) and an open position (shown in FIG. 3).

Figure 7:
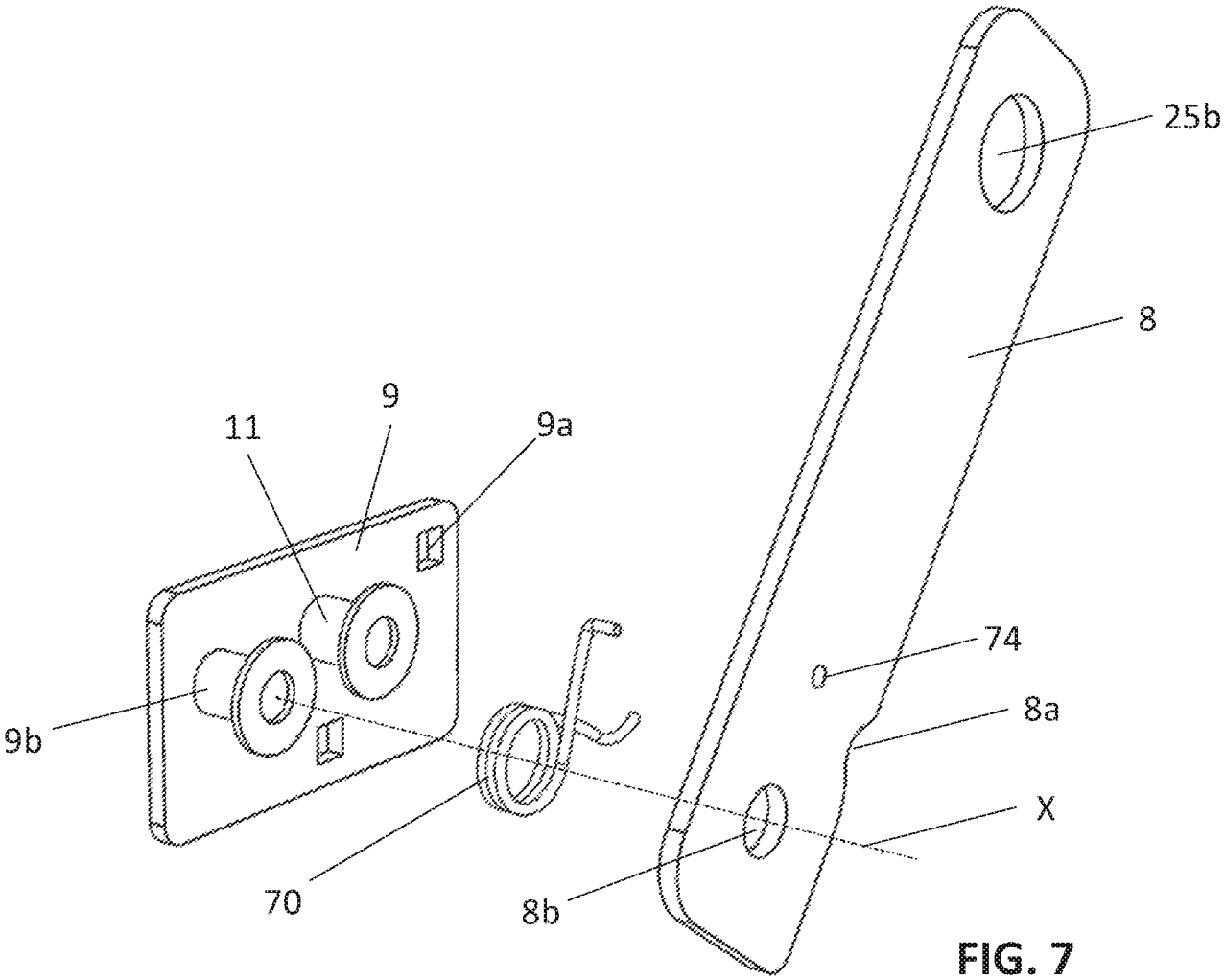
FIG. 7 is an exploded assembly view of the pivoting arm/support member assembly.

Likewise, the pivoting arm 8 is pivotally mounted to the support member 9 for rotation around axis X. The mounting is such that the pivoting arm 8 may freely rotate about axis X, while the support member 9 is in a fixed position by being attached to the left side wall 3*b* of the waste container 2. Thus, pivoting arm 8 is mounted to the support member 9 for pivoting movement between a closed position (shown in FIGS. 1-2) and an open position (shown in FIG. 3). In an exemplary embodiment, as illustrated in FIGS. 2 and 7, the pivoting arm 8 contains a hole 8*b* that fits around a flanged post 9*b* which extends substantially perpendicularly to the plane of support member on axis X. The diameter of the hole 8*b* is preferably slightly larger than the diameter of the flanged post 9*b* so that the pivoting arm 8 can freely rotate around the flanged post 9*b*. When in the closed position, as best illustrated in FIG. 2, an edge of the pivoting arm 8 rests on the stop member 11. In a preferred embodiment, as best illustrated in FIG. 7, the pivoting arm 8 contains a concave support recess 8*a* for resting on the stop member 11, when it is in the closed position. Further, a bottom end of the pivoting arm 8 is also configured to engage the stop member 11 when the pivoting arm 8 is in the open position so as to prevent further pivoting movement of the pivoting arm 8 relative to support member 9. In other words, the stop member 11 limits the pivoting movement of the support member 9 relative to the base unit 12 both in the close and open position of the support member 9.

Figure 8:
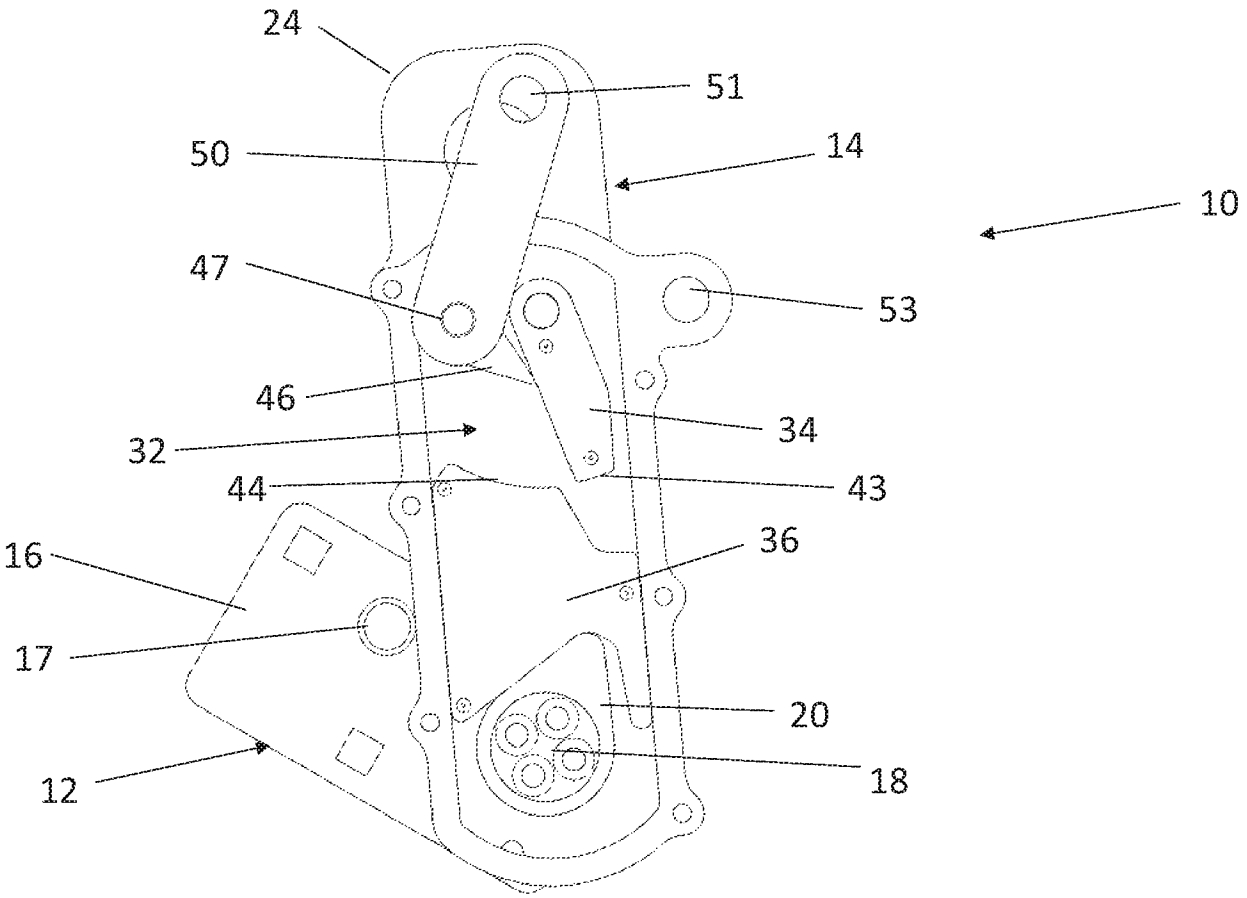
FIG. 8 is a partial view of the locking mechanism showing the action of the manual release lever and pivot lever on the locking member.

The pivoting unit 14 further includes an automatic, pivoting locking mechanism 32 disposed in the cavity 29, as best shown in FIG. 8. Thus, the locking mechanism 32 is adapted to rotate (pivot) with the pivoting unit 14 of the waste container 2. The locking mechanism comprises a locking member 34 pivotally mounted within the cavity 29, a sliding member 36, located within the cavity 29, reciprocatingly and slidingly movable between the locking member 34 and the pinion member 18, and a pivot lever 46 mounted within the cavity 29. Preferably, a thickness of the locking mechanism 32, i.e., of each of the locking member 34, the sliding member 36, and the pivot lever 46, is substantially equal to or slightly less than a thickness of the intermediate member(s) 26. Such an arrangement allows the locking member 34, the sliding member 36, and the pivot lever 46 to be moveably disposed within the cavity 29 defined by the hollow intermediate member 26 sandwiched between the inner plate 24 and the outer plate 22.

Figure 4A:
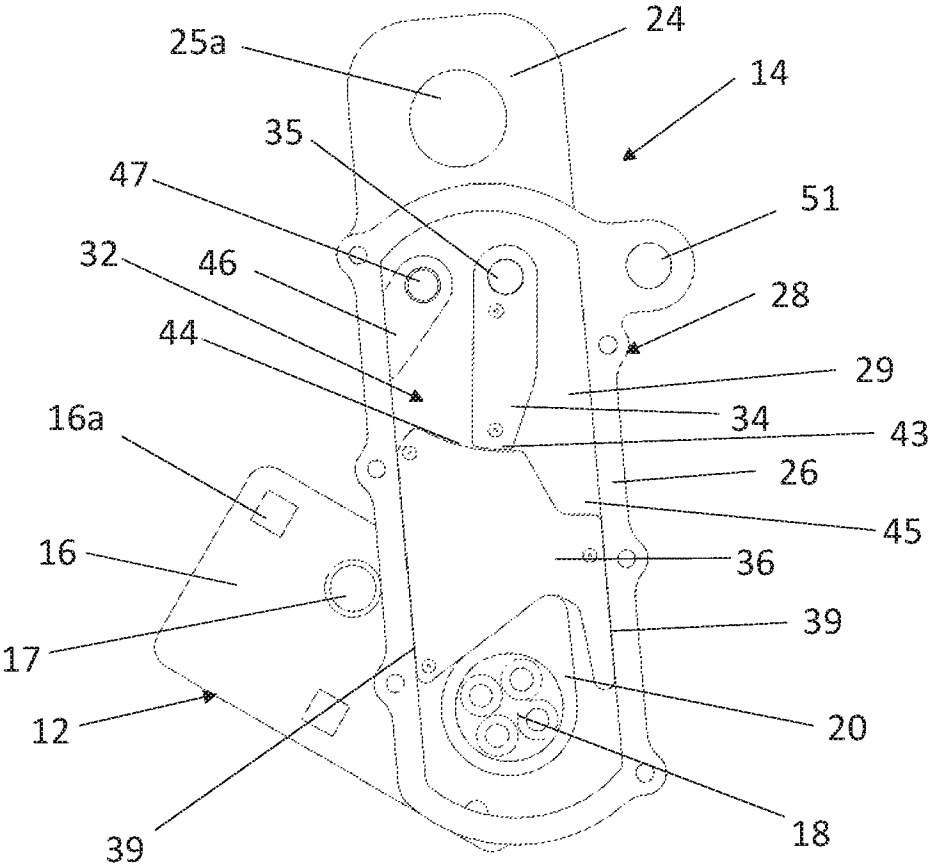
FIG. 4A is a side view of FIG. 4 with the manual release lever removed.

As best shown in FIG. 4A, the locking member 34 is pivotally mounted to a first pivot shaft 35 (also shown in FIG. 4 as dashed line under the manual release lever 50), while the pivot lever 46 is non-rotatably mounted (or fixed) to a second pivot shaft 47. The pivot shaft 35 and the pivot shaft 47 are spaced from each other and extend between the inner and outer plate 24 and 22, respectively.

The sliding member 36 is a flat plate configured to cooperate with the locking member 34 and the cam 20 so that the pivoting unit 14 may rotate relative to the base unit 12. The sliding member 36 has opposite, substantially parallel side surfaces 39 slidingly engaging opposite inner surfaces of the intermediate member 26. A first end of the sliding member 36 adjacent to the locking member 34 has an arcuate (concave) surface 44. Preferably, the arcuate surface 44 of the sliding member 36 is complementary to a stop surface 43 on a distal end of the locking member 34. In other words, a radius of curvature of the arcuate stop surface 43 of the locking member 34 is complementary to (matches) a radius of curvature of the arcuate surface 44 of the sliding member 36. The arcuate surface 44, however, does not span the width of the sliding member 36. When the locking member 34 is in contact with the sliding member 36, it prevents the sliding member 36 from sliding toward the pivot lever 46 (sliding upwardly). On the sliding member 36, adjacent to the arcuate surface 44, toward the front of the locking device 10, is an indentation 45. The indentation 45 assures that when the locking member 34 swings forward, as best illustrated in FIG. 5, it allows the sliding member 36 to slide upwardly toward the pivot lever 46.

A second end of the sliding member 36 adjacent to the cam 20 has a notch 60, as best shown in FIG. 5, spanning the width of the sliding member 36. The notch 60 cooperates with the cam 20 to push the sliding member 36 upward toward the pivot lever 46. The notch 60 is preferably rectangular with a first side 60*a* and a second side 60*b* meeting at an apex 60*c*. The cam 20 is a plate that approximates a tear-drop shape whose perimeter includes a first support surface 20*a* and a second support surface 20*b* forming a cam lobe 20*c* therebetween.

The locking member 34 is adapted to translate from a first blocking position (shown in FIG. 4) preventing pivoting movement of the pivoting unit 14 relative to the base unit 12 (thus, the locking bar 6 relative to the waste container 2) to a second release position (shown in FIG. 5) permitting pivoting movement of the pivoting unit 14 relative to the base unit 12 (thus, the locking bar 6 relative to the waste container 2). In other words, the locking member 34 translates from the first blocking position, preventing linear displacement of the sliding member 36 relative to the pinion member 18, to the second release position permitting movement of the sliding member 36 relative to the pinion member 18. In the first blocking position, as shown in FIG. 4, stop surface 43 of the locking member 34 rests on the arcuate surface 44 of the sliding member 36, thereby preventing the locking member 34 from sliding upwardly toward the pivot lever 46. In that position, the lobe 20*c* of the cam 20 rests on the apex 60*c* of the notch 60. Because the sliding member 36 cannot slide upwardly in that configuration, the pivoting unit 14 cannot be rotated relative to the base unit 12. In the second release position, as shown in FIG. 5, the locking member 34 may swing forwardly towards the indentation 45, thereby allowing the sliding member 36 to slide upwardly. In that position, when the pivoting unit 14 is pulled forward to rotate relative to the base unit 12, the cam 20, being fixed to the base unit 12, pushes the sliding member 36 upwardly by sliding the first side 60*a* of the notch 60 against the lobe 20*c* of the cam 20.

The locking device 10 may be mounted to the waste container 2 so that when the waste container 2 is in its upright storage position, locking member 34 is held against the arcuate surface 44 of the sliding member 36 by gravity. In that position, the arcuate surface 44 of the sliding member 36 engages the arcuate stop surface 43 of the locking member 34, as illustrated in FIG. 4. In this position, the locking member 34 blocks (prevents) the sliding linear movement of the sliding member 36 relative to the pinion member 18 and the lock casing 28, thus preventing pivoting movement of the pivoting unit 14 relative to the base unit 12. In other words, the locking member 34 is in the first blocking position (shown in FIGS. 10 and 11) and prevents the locking bar 6 from rotating relative to the waste container 2, thus maintaining the locking bar 6 in the closed position. However, by tilting the waste container 2 forwardly, in the direction of arrow A (shown in FIG. 3), the locking member 34 rotates about the shaft 35 within the cavity 29 to its second release position and no longer blocks the sliding member 36 from sliding upwardly. In that position, the pivoting unit 14 may be rotated relative to the base unit 12. Thus, in the second release position of the locking member 34, the locking bar 6 can rotate relative to the waste container 2 from the closed position to the open position.

The pivot lever 46 of the locking mechanism 32 is disposed within the cavity 29 and is pivotally mounted to the outer plate 22 of the pivoting unit 14 through the shaft 47, as shown in FIGS. 4-5. Alternatively, the pivot lever 46 may be pivotally mounted to the inner plate 24 of the pivoting unit 14 through the shaft 47. Also, the shaft 47 preferably extends through a hole in the outer plate 22 so that an outer distal end of the shaft 47 extends outside the outer plate 22, as shown in FIG. 1, and is non-rotatably fixed to the pivot lever 46. The outer distal end of the shaft 47 is non-rotatably fixed to a manual release lever 50 disposed outside the lock casing 28. In other words, both the pivot lever 46 and the manual release lever 50 are rotatable relative to the outer plate 22 (i.e., the lock casing 28) of the pivoting unit 14, but are not rotatable relative to the shaft 47. It is clear, therefore, that the rotational movement of the manual release lever 50 causes corresponding rotational movement of the pivot lever 46.

As illustrated in FIGS. 4-5 and 8, the pivot lever 46 is disposed and is rotationally moveable in the cavity 29 of the lock casing 28 between the inner plate 24 and the outer plate 22, so that a distal end of the pivot lever 46 is located adjacent to a distal end of the locking member 34. The pivot lever 46 has a length such that when the locking member 34 is in the first blocking position, the pivot lever 46 can push and rotate the locking member 34 towards the second release position if the pivot lever 46 is rotated toward the locking member 34 (counter clockwise as shown in FIG. 8). Thus, the manual release lever 50 is provided for manually moving the locking member 34 from the blocking position to the release position regardless of a tilt angle of the locking mechanism 32, as both the manual release lever 50 and the pivot lever 46 are non-rotatably connected to the pivot shaft 47. In other words, the pivot lever 46 allows bypassing the gravity operated locking mechanism 32 by rotating the manual release lever 50 by an authorized person. Thus, the manual release lever 50 may be in a release position to allow for the opening of the locking device 10, or in a locking position allowing the blocking member 34 to block the opening of the locking device 10. When the manual release lever 50 is in its locking position, the locking device 10 may still be opened by tilting it to allow the locking member 34 to be pulled into its release position by gravity.

Figure 6:
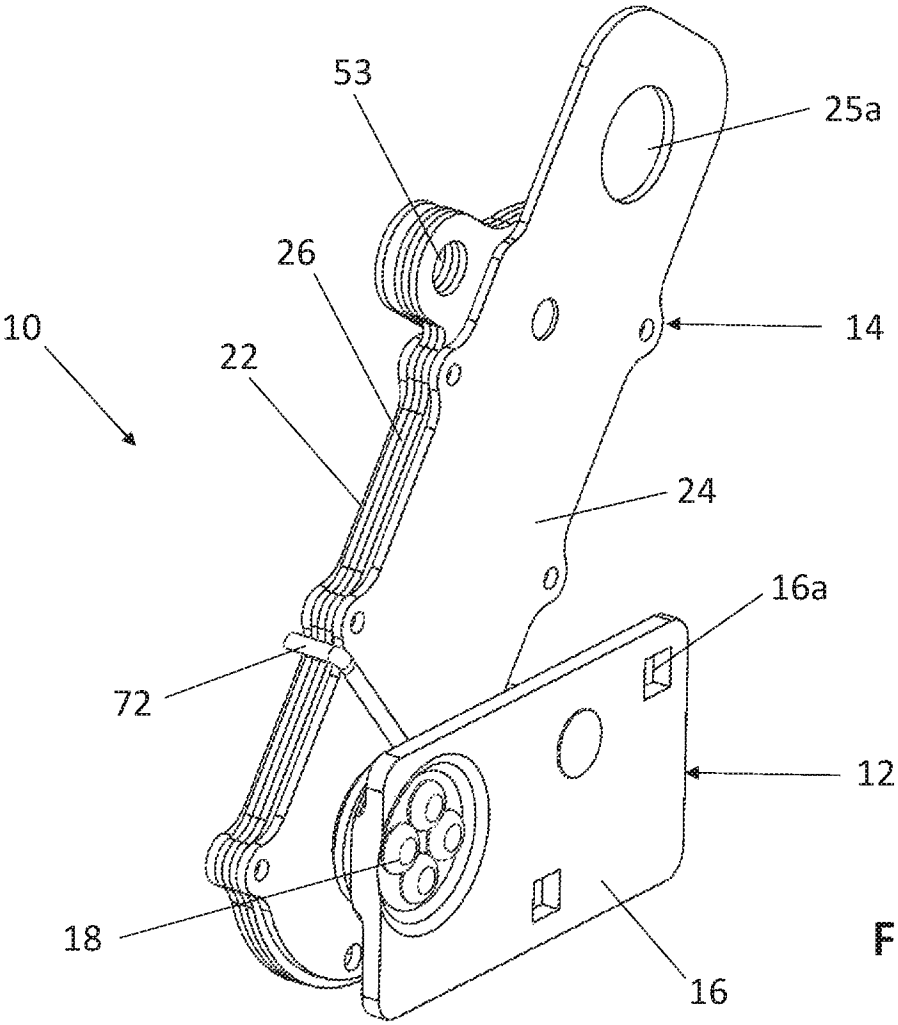
FIG. 6 is a fragmentary perspective view of the locking device in a closed position from the inner plate side.
Figure 9:
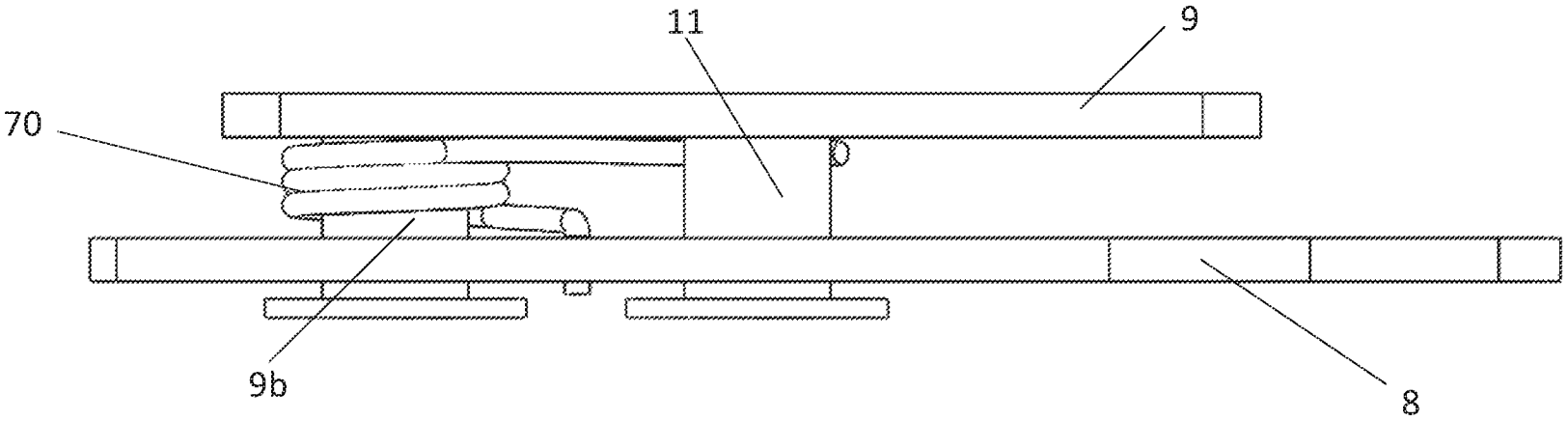
FIG. 9 is a top view of the pivot bar/support member assembly.
Figure 10:
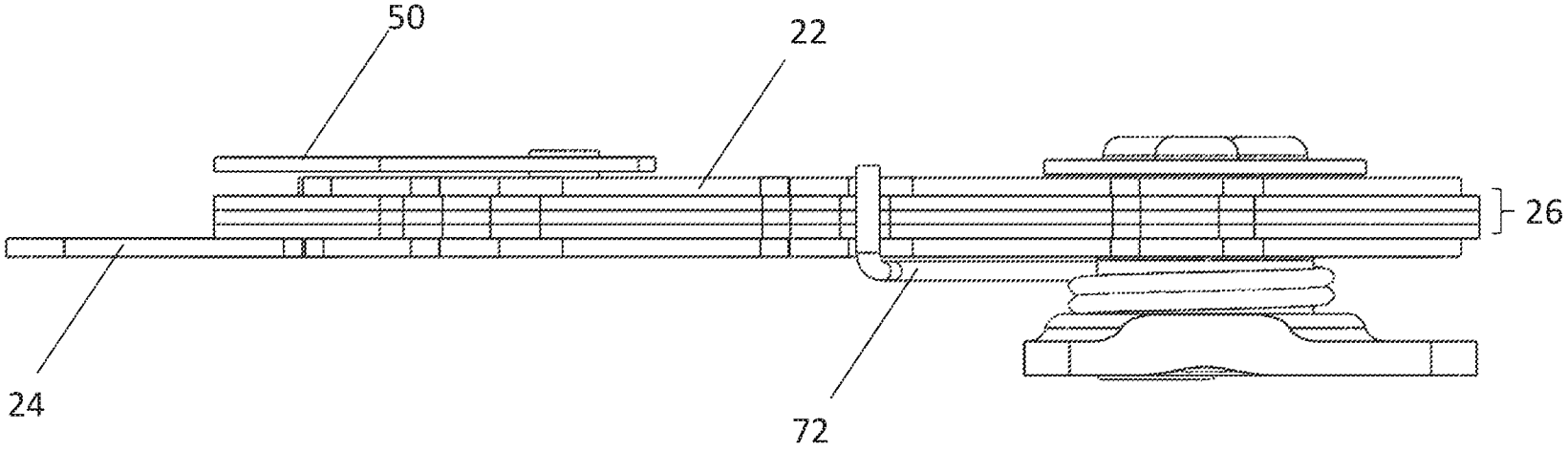
FIG. 10 is a top view of the locking device.

In certain embodiments, as illustrated in FIGS. 6 and 10, a spring 72 may be used to bias the locking device 10 into the closed position. The spring force is preferably sufficiently weak so that, when the container 2 is in the tilted or dumping position, gravity is sufficient to overcome the spring force and allow the locking device to move to the open position. The spring 72 is preferably a torsion spring with one end hooked onto the pivoting unit 14 (as shown in FIGS. 6 and 10) and the other end fixed to the base member 16 and coiled around axis X. Likewise, as shown in FIGS. 7 and 9, a spring 70 may also be used to bias the pivoting arm 8 into the closed position. The spring 70 is preferably a torsion spring coiled around the flanged post 9*b* with one end hooked under the stop member 11 and the other end fixed to the pivoting arm 8, e.g. by being inserted into a hole 74 on the pivoting arm 8 (see FIG. 7). Although torsion springs 70 and 72 are shown in the drawings, other biasing devices may also be used to achieve the same purpose. Further, although the drawings show a spring on each of the locking side (locking device 10) and the dummy side (pivoting arm/support member assembly), both may not be needed. Indeed, it may be possible that one spring on either the locking side or the dummy side is sufficient to put the locking device 10 in its close position.

In order to prevent rotation of the manual release lever 50 relative to the lock casing 28 by an unauthorized person, a padlock may be used. Specifically, when the manual release lever 50 is in its locking position, the padlock may be used to lock together the manual release lever 50 and the intermediate member 26 of the lock casing 28 by extending through holes 51 and 53 (see FIG. 8) through the manual release lever 50 and the intermediate member 26, respectively. It will be appreciated that any type of manual lock which locks the manual release lever 50 to the lock casing 28 may be employed in order to allow only an authorized person to unlock the manual release lever 50. Thus, the pivot lever 46 has a locked and unlocked position provided by the padlock (not shown) being placed through holes 51 and 53 to prevent unauthorized rotation of the release lever 50.

In order to bypass the locking mechanism, the padlock may be removed from holes 51 and 53 to unlock the manual release lever 50 from the lock casing 28, and then the manual release lever 50 may be rotated to its release position (as shown in FIG. 8). Subsequently, the locking bar 6 may be rotated clockwise to the open position. In this position, the locking bar 6 is spaced from the hinged lid 4 of the waste container 2, so as to allow the opening of the hinged lid 4 of the waste container 2. In other words, the locking device 10 allows bypassing of the gravity operated locking mechanism 32 by rotating the manual release lever 50 by an authorized person.

In operation, when it is desirable to remove the contents of the container 2, the container 2 may be grabbed by a lifting mechanism, e.g. of a waste collection truck (not shown), and moved from the upright position to the tilted or dumping position. When in the upright position, the locking member 34 of the gravity operated locking mechanism 32 is in the blocking position (as shown in FIG. 4). Accordingly, the pivoting unit 14 is not allowed to pivot to its open position. However, when the waste container 2 is substantially tipped forward or tilted to a predetermined angle, about 40-50°, gravity pulls the locking member 34 from the blocking position (shown in FIG. 4) to the release position (shown in FIG. 5). In the release position, the locking member 34 no longer obstructs linear displacement of the sliding member 36 relative the pinion member 18. Subsequently, the pivoting unit 14 is allowed to pivot (by gravity of the pivoting unit 14, the pivoting arm 8 and the locking bar 6) to its open position, as shown in FIG. 5. Consequently, the pivoting unit 14 and the locking bar 6 rotate by gravity from the closed position to the open position. As the pivoting unit 14 rotates relative to the axis X (or the pinion member 18), the sliding member 36, which drivingly engages the pinion member 18, is linearly displaced in the direction away from the pinion member 18 and toward the locking member 34. The lid 4 of the waste container 2 may then swing open by gravity, permitting the contents of the waste container 2 to be emptied.

When in the closed position, the arcuate stop surface 43 of the locking member 34 engages the arcuate surface 44 of the sliding member 36 (best shown in FIG. 4) to orient the locking member 34 into its blocking position. In that position the locking member 34 prevents the sliding member 36 from being linearly displaced in the direction towards the locking member 34, thereby restraining clockwise rotation of the pivoting unit 14 and the locking bar 6 about the pivot axis X. When the locking member 34 is in the release position and the pivoting unit 14 rotates to the open position, the sliding member 36 is linearly displaced in the direction away from the pinion member 18 and towards the locking member 34. The rotation of the pivoting unit 14 stops when the locking member 34 engages the indentation 45 of the sliding member 36 or when the sliding member 36 abuts the pivot lever 46.

It will be appreciated that the gravity operated locking mechanism 32 operates automatically and independently of the locking condition of the manual release lever 50. In other words, when the waste container 2 is tilted, the locking mechanism 32 is opened whether the manual release lever 50 is locked with the padlock or not. As the waste container 2 is returned to its upright position, the lid 4 closes by gravity, then the pivoting unit 14 and the locking bar 6 move, by gravity and/or biasing force of the springs 70 and 72, to the closed position, and the locking member 34 is returned, by gravity, to its blocking position.

Manual release of the locking member 34 by an authorized person may be achieved by use of the release lever 50. When the padlock is in place (i.e. the release lever 50 is in the blocking position), movement of the manual release lever 50 (thus the pivot lever 46) is restricted. When the padlock is removed by an authorized person, e.g. by using a designated key or lock combination, the manual release lever 50 is allowed to pivot (counterclockwise as shown in FIG. 8) so that the distal end of the pivot lever 46 pushes the locking member 34 to its release position (as best shown in FIG. 8), which then allows the pivoting unit 14 (along with the locking bar 6) to pivot to the open position (as shown in FIG. 3).

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for making a locking device, the method comprising the steps of a) providing a base unit including a base member and a pinion member non-movably attached to the base member;

b) mounting a pivoting unit to the base unit, wherein the pivoting unit is pivotable relative to the base unit between a closed position and an open position, and wherein the pivoting unit includes a lock casing housing the pinion member; and c) providing a locking mechanism in the lock casing, wherein the locking mechanism comprises i) a locking member pivotally mounted to the lock casing, and ii) a sliding member reciprocatingly and slidingly movable between the locking member and the pinion member, wherein the sliding member drivingly engages a surface of the pinion member so that rotational movement of the pivoting unit from the closed position to the open position causes the pinion member to linearly displace the sliding member toward the locking member, and wherein the locking member is pivotally movable between a blocking position and a release position, when the locking member is in the blocking position, the blocking member is in contact with a surface of the sliding member to prevent movement of the sliding member relative to the pinion so as to prevent the pivoting unit from pivoting from the closed position to the open position, and when the locking member is in the release position, the blocking member is released from contact with the surface of the sliding member to permit movement of the sliding member relative to the pinion so as to allow the pivoting unit to pivot from the closed position to the open position.

2. The method of claim 1, wherein the sliding member is a flat plate having a first end and an opposite second end, the second end contains a notch; and the surface of the pinion member includes a cam fitting within the notch.

3. The method of claim 2, wherein the pinion member is a flat metal plate fixed to the base member, and the cam encircles a perimeter of the pinion member and is in contact with the sliding member.

4. The method of claim 2, wherein the locking member contains a first end and an opposite second end, the first end is pivotably mounted to the lock casing, the second end contains a stop surface, when in its blocking position, the stop surface abuts against the surface of the sliding member to prevent relative movement between the pivoting unit and the base unit.

5. The method of claim 4, further comprising the step of providing an arcuate surface at the first end of the sliding member and complementary to the stop surface of the locking member.

6. The method of claim 5, further comprising the step of providing an indentation on the sliding member and adjacent to and forward of the arcuate surface, the indentation is configured to accommodate the locking member when the locking member is its release position.

7. The method of claim 1, further comprising the step of providing a biasing spring in the locking mechanism, the biasing spring is configured to bias the pivoting unit to the closed position.

8. The method of claim 7, wherein the biasing spring is a torsion spring with a first end connected onto the pivoting unit and a second end connected to the base member.

9. The method of claim 1, wherein step b) comprises fixing a series of plate-shaped members together to form the pivoting unit.

10. The method of claim 9, wherein the plate-shaped members include an inner plate pivotally mounted to the base member, an outer plate, and at least one hollow plate-shaped intermediate member sandwiched between the inner plate and the outer plate, the plate-shaped members define a cavity in which the locking member and the sliding member are moveably disposed.

11. The method of claim 10, wherein the intermediate member comprises opposing inner surfaces, and the sliding member comprises substantially parallel side surfaces slidingly engaging the inner surfaces of the intermediate member.

12. The method of claim 10, wherein the locking member and the sliding member have a thickness less than the thickness of the at least one hollow plate-shaped intermediate member.

13. The method of claim 1, further comprising the step of providing a pivot lever in the locking mechanism, the pivot lever is engageable with the locking member in the blocking position to translate the locking member out of the blocking position toward the release position.

14. The method of claim 13, further comprising the step of non-rotatably connecting a manual release lever to the pivot lever for manually moving the pivot lever.

15. The method of claim 14, wherein the manual release lever contains a through hole to allow it to be locked in its locking position by a padlock.

16. The method of claim 1, further comprising the step of non-moveably securing a stop member to the base member, the stop member extending approximately perpendicularly from the base member for limiting rotation of the pivoting unit.

17. A method for making a container, the method comprising the steps of:

a) providing a container body;

b) hingedly mounting a lid to the container body, the lid moveable between a closed position when the container is in an upright position and an open position when the container is in a tilted position; and c) mounting a locking device to the container body, the locking device comprises i) a base unit including a base member and a pinion member non-movably attached to the base member;

ii) a pivoting unit mounted to the base unit and pivotable between a closed position and an open position; and iii) a pivoting unit mounted to the base unit and pivotable relative to the base unit between a closed position and an open position, the pivoting unit including a lock casing, the lock casing housing a locking mechanism and the pinion member, the locking mechanism comprising a locking member pivotally mounted to the lock casing, a sliding member reciprocatingly and slidingly movable between the locking member and the pinion member, and the sliding member drivingly engaging a surface of the pinion member so that rotational movement of the pivoting unit from the closed position to the open position causes the pinion member to linearly displace the sliding member toward the locking member;

the locking member is pivotally movable between a blocking position and a release position, when the locking member is in the blocking position, the blocking member is in contact with a surface of the sliding member to prevent movement of the sliding member relative to the pinion so as to prevent the pivoting unit from pivoting from the closed position to the open position, and when the locking member is in the release position, the blocking member is released from contact with the surface of the sliding member to permit movement of the sliding member relative to the pinion so as to allow the pivoting unit to pivot from the closed position to the open position.

18. The method of claim 17, further comprising the steps of mounting a support member to the container body opposing the locking device;

mounting a pivoting arm on to the support member, the pivoting arm is pivotable relative to the support member; and mounting a first end of the locking bar to the pivoting unit and a second end of the locking bar to the pivoting arm, wherein when the pivoting unit is in the closed position, the locking bar is positioned over the hinged lid to prevent access to the container body, and when the pivoting unit is in the open position, the locking bar is spaced away from the lid to allow opening of the container.

19. The method of claim 17, wherein the pivoting unit comprises a series of plate-shaped members fixed together to enclose the locking mechanism and the pinion member.

20. The method of claim 19, wherein the plate-shaped members include an inner plate pivotally mounted to the base member, an outer plate, and at least one hollow plate-shaped intermediate member sandwiched between the inner plate and the outer plate, the plate-shaped members define a cavity in which the locking member and the sliding member are moveably disposed.

* * * * *